US006417440B2

(12) United States Patent
Furuki

(10) Patent No.: US 6,417,440 B2
(45) Date of Patent: Jul. 9, 2002

(54) DAMPER FORMED OF POWDER-CONTAINING SYNTHETIC RESIN AND KEYBOARD MUSICAL INSTRUMENT EQUIPPED WITH THE SAME

(75) Inventor: Fumiyoshi Furuki, Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/847,114

(22) Filed: May 1, 2001

(30) Foreign Application Priority Data

May 1, 2000 (JP) ..... 2000-132814

(51) Int. Cl.[7] ..... G10H 1/32

(52) U.S. Cl. ..... 84/719; 84/216; 84/255; 84/452 R

(58) Field of Search ..... 84/216–219, 254, 84/255, 719, 452 R, 452 P

(56) References Cited

U.S. PATENT DOCUMENTS 1,353,644 A * 9/1920 George
4,203,341 A * 5/1980 Takahashi ..... 84/255
4,602,549 A * 7/1986 Kumano
4,852,445 A * 8/1989 Rochefordiere ..... 84/218
4,879,939 A * 11/1989 Wall
5,022,302 A * 6/1991 Guyon ..... 84/255
5,528,969 A * 6/1996 Kihara et al. ..... 84/171 X
5,616,880 A * 4/1997 Hayashida et al. ..... 84/719
5,811,702 A 9/1998 Tomizawa et al.
5,932,820 A 8/1999 Kihara

* cited by examiner

*Primary Examiner*—Jeffrey Donels
(74) *Attorney, Agent, or Firm*—Morrison & Foerster LLP

(57) ABSTRACT

Dampers are spaced from and brought into contact with associated sets of strings for defining piano tones, and the vibration absorbing capability is to be equalized among the dampers by regulating the weight, wherein at least one of the damper head and the damper lever is formed of powder-containing synthetic resin so that the damper is economical, durable and free from the environmental pollution.

21 Claims, 5 Drawing Sheets

DAMPER FORMED OF POWDER-CONTAINING SYNTHETIC RESIN AND KEYBOARD MUSICAL INSTRUMENT EQUIPPED WITH THE SAME

FIELD OF THE INVENTION

This invention relates to a keyboard musical instrument and, more particularly, to dampers appropriate to a keyboard musical instrument and a keyboard musical instrument equipped with the dampers for damping vibrations of strings.

DESCRIPTION OF THE RELATED ART

A damper is an essential component of an acoustic piano. The damper is linked with a key. The key gives rise to reciprocal motion of a damper head assembly. While the key is resting, the damper head assembly is held in contact with a set of strings, and prevents the set of strings from resonation with vibrating strings. A pianist is assumed to depress the key for generating a piano tone. The depressed key gives rise to upward motion of the damper head assembly, and, accordingly, the damper head assembly is spaced from the associated set of strings. The set of strings gets ready for vibrations. A hammer strikes the set of strings, and the set of strings vibrates for generating the piano tone. When the pianist releases the depressed key, the key is moved toward the rest position, and permits the damper head assembly to be brought into contact with the vibrating strings. The vibrations are taken up with the damper head assembly, and the piano tone is decayed. Thus, the damper deeply concerns the length of the piano tone.

FIG. 1 shows a typical example of the damper incorporated in a standard grand piano. In FIG. 1, the right side is closer to a pianist sitting in front of the standard grand piano than the left side, and is hereinbelow referred to as "front". Oppositely, the left side is referred to as "rear".

The prior art damper is designated in its entirety by reference numeral 1. The prior art damper 1 is associated with a key 2 and a set of strings 3. Although an action mechanism 2*a* and a hammer assembly 3*a* are provided for the key 2, the action mechanism 2*a* and the hammer assembly 3*a* are similar to those of the standard grand piano, and no further description is hereinbelow incorporated.

A note of the scale is assigned to the key 2, and the set of strings 3 generates a piano tone with the note identical with that assigned to the key 2. While the key 2 is resting, the prior art damper 1 is held in contact with the set of strings 3, and prohibits the set of strings 3 from vibrations. When a pianist generates the piano tone, he or she depresses the key 2, and the key 2 actuates the prior art damper 1. The prior art damper 1 leaves from the set of strings 3, and permits the set of strings 3 to vibrate for generating the piano tone. The depressed key 2 actuates the action mechanism 2*a,* and the jack of the action mechanism 2*a* escapes from the hammer assembly 3*a.* The escape gives rise to free rotation of the hammer assembly 3*a,* and the set of strings 3 is struck by the hammer assembly 3*a.* The set of strings 3 vibrates so as to generate the piano tone. Thus, the set of strings 3 is allowed to vibrate while the prior art damper 1 is being spaced therefrom. The position at which the prior art damper 1 prohibits the set of strings 3 from the vibrations is hereinbelow referred to as "rest position", and the position at which the prior art damper 1 permits the set of strings 3 to vibrate is hereinbelow referred to as "tone generating position".

The prior art damper 1 comprises a damper lever flange 4, a damper block 5, a damper wire 6, a damper head assembly 7, which includes a damper head 7A and a pair of damper felts 8, and a damper flange 9. The damper lever 4 is swingably supported by the damper lever flange 9, and forwardly projects therefrom. The damper lever 4 is formed of wood, and holes are formed in the damper lever 4. The damper block S is connected to the damper lever 2 by means of a pin, and upwardly projects from the damper lever 2. The damper block 5 is rotatable around the pin. The damper wire 6 is fixed to the damper block 5, and upwardly projects therefrom. A guide rail 10 is located over the damper flange 9, and a hole is formed in the guide rail 10. The damper wire 6 passes through the hole, and projects over the guide rail 10. The hole is wide enough to permit the damper wire 6 smoothly to move therethrough. The damper head assembly 7 is fixed to the upper end of the damper wire 6.

As described hereinbefore, the damper head 7A and the pair of damper felts 8 as a whole constitute the damper head assembly 7. The damper head 7A is formed of wood, and the damper felts 8 are formed of felt. Hard wood is preferable for the damper head 7A. Isunoki or Onoore is large in specific weight, and the damper head 7A is usually formed of one of these kinds of hard wood. Isunoki or Onoore are Japanese names. Their botanical names are "distylium racemosum" and "betula schmidtii regel". Although Isunoki does not have any English name, Onoore is usually translated in English as "birch" or "Onoore birch". The damper felts 8 are fixed to the lower surface of the damper head 7A, and are spaced from one another in the fore-and-aft direction.

While the key 2 is resting in the rest position, the rear portion of the key 2 is spaced from the damper lever 2, and the damper head assembly 7 urges the damper wire 6 downwardly due to the self-weight. The damper wire 6 in turn urges the damper lever 2 in the clockwise direction around the damper lever flange 9. However, the pair of damper felts 8 is held in contact with the set of strings 3, and keeps the damper lever 4 spaced from the rear portion of the key 2.

When the pianist depresses the front portion of the key 2, the front portion of the key 2 sinks toward the front rail, and, accordingly, the rear portion of the key 2 is lifted upwardly. The rear portion of the key 2 is brought into contact with the damper lever 4, and gives rise to rotation of the damper lever 4 around the damper flange 9 in the counter clockwise direction. Although the damper block 5 and the damper wire 6 are rotated around the damper flange 9 together with the damper lever 4, the guide rail 10 does not allow the damper wire 6 and, accordingly, the damper block 5 to be rotated around the damper flange 9. The guide rail 10 and the pin between the damper lever 4 and the damper block 5 convert the rotation of the damper wire 6 and the damper block 5 to straight motion. As a result, the damper block 5 and, accordingly, the damper wire 6 are moved upwardly as indicated by arrow A1. The damper wire 6 pushes up the damper head assembly 7, and, accordingly, the pair of damper felts 8 is spaced from the set of strings 3. Thus, the prior art damper 1 enters the tone generating position, and allows the set of strings 3 to vibrate for generating the piano tone. The depressed key 2 further actuates the action mechanism 2*a,* and causes the jack to escape from the hammer assembly 3*a.* The escape gives rise to the free rotation of the hammer assembly 3*a,* and the set of strings 3 is struck by the hammer assembly 3*a.* Thus, the prior art damper 1 at the tone generating position permits the set of strings 3 to vibrate for generating the piano tone.

A pedal mechanism 11 is provided for the prior art damper 1. The pedal mechanism 11 includes a foot pedal 12, a lifting rod 13 and a lifting rail 14. The foot pedal 12 is rotatably supported by a lyre box (not shown), and the lifting rod 13 is connected to the rear portion of the foot pedal 12. The lifting rod 13 upwardly extends, and projects into the piano case. The lifting rail 14 is swingably supported by the damper lever flange 9, and is located under the damper lever 4. Though not shown in FIG. 1, the pedal mechanism 11 is shared with the prior art dampers associated with other keys (not shown), and the lifting rail 14 laterally extends over all the damper levers or selected ones of the damper levers.

When the pianist wishes to prolong the piano tone or tones, he or she steps on the pedal 12. The pedal 12 is sunk, and, accordingly, the lifting rod 13 is moved upwardly. The lifting rod 13 pushes the lifting lever 14, and is rotated around the damper lever flange 9 in the counter clockwise direction. Accordingly, the lifting rail 14 is brought into contact with the lower surfaces of the damper levers 4, and the damper levers 4 are rotated around the damper lever flange 9 in the counter clockwise direction. This results in that the damper head assemblies 7 are spaced from the set of strings 3. Thus, the pedal mechanism 11 can keep the damper head assemblies 7 spaced from the associated sets of strings 3 regardless of the key positions. For this reason, even though the pianist releases the key 2, the pedal mechanism 11 supports the self-weight of the damper head assembly 7, and keeps the set of strings 3 vibrating.

As described hereinbefore, the notes of scale are assigned to the keys 2, and the associated sets of strings 3 generate the piano tones at the given notes. The piano tones are generally broken down into a lower pitched part, a middle pitched part and a higher pitched part, and the strings 3 are different in the diameter, length and number from one another. A single or two strings 3 are assigned each note of the lower pitched part, two or three strings 3 are assigned each note of the middle pitched part, and three strings are assigned each note of the high pitched part. The strings assigned a lower pitched tone are thicker and longer than the strings assigned a higher pitched tone, and widely vibrate rather than the strings assigned the higher pitched tone. This means that the vibrating energy is different depending upon the strings 3. Accordingly, the damper head assemblies 7 are designed equally to absorb the vibrations regardless of the size of the strings 3. In order to make the vibration absorbing capability equalized, the prior art dampers 1 are designed to be different in weight from one another. The weight of the prior art damper 1 is decreased from the lowest pitched tone toward the highest pitched tone. However, it is impossible to regulate the weight by only changing the size of the damper head 7A. Metal pieces 15 of lead are embedded into the damper lever 4 for regulating the weight appropriately. The total weight of the metal pieces 15 are decreased from the lowest pitched tone toward the highest pitched tone. Thus, it is necessary to change the metal pieces 15 as well as the damper head 7A for appropriately regulating the vibration absorbing capability of the prior art damper 1.

The following problems are encountered in the prior art damper 1. First, the weight of the damper head 7A is liable to be dispersed among the products. This is because of the fact that the specific weight of the hard wood is varied depending upon the age of the tree and the district where the tree was grown. Under these circumstances, even if the manufacturer strictly designs the prior art dampers 1 for the sets of strings assigned the different notes, the dispersion is unavoidable among the products.

Another problem is the increased production cost. The hard wood is getting drained. It is difficult to obtain those kinds of hard wood stably and economically. As a result, the production cost is increased. Another factor is low productivity of the damper levers 4. The manufacturer determines the dimensions of the holes, and forms the holes in each of the damper levers 4. The metal pieces are tailored, and are embedded into the damper levers 4. Thus, the damper levers 4 are regulated in weight through a series of steps, and the complicated steps are causative of the high production cost.

Yet another problem is the durability of the damper levers 4. As described hereinbefore, the damper levers 4 are formed of wood, and the metal pieces 15 are embedded in the damper levers 4. Even if the metal pieces 15 are snugly received in the holes formed in the damper levers 4, the damper levers 4 of wood become dry, and the holes are deformed. Gap takes place between the damper lever 4 and the metal pieces 15. The gap is an origin of noise, and the metal pieces 15 are liable to be dropped from the damper lever 4.

Still another problem is the environmental pollution. The metal pieces 15 are formed of lead, and are directly exposed to the environment. Although the lead is large in specific weight and easy for machining, the lead is undesirable from the aspect of the environment. When the damper levers 4 are worn-out, the metal pieces 15 of lead give rise to environmental pollution in so far as they are not carefully handled.

SUMMARY OF THE INVENTION

It is therefore an important object of the present invention to provide a damper, which is strictly regulable in weight, economical, durable and free from the environmental pollution.

It is another important object of the present invention to provide a keyboard musical instrument, which is equipped with the damper.

To accomplish the object, the present invention proposes to form at least one component of powder-containing synthetic resin.

In accordance with one aspect of the present invention, there is provided a damper for absorbing vibrations of a string comprising a damper lever actuated for rotation by a key, a damper assembly having a damper head and a vibration absorbing member fixed to the damper head, and changed between a rest position where the vibration absorbing member is held in contact with the string and a tone generating position where the vibration absorbing member is spaced from the string and a link mechanism connected between the damper lever and the damper head for transmitting a force from the damper lever to the damper assembly, wherein at least one of the damper lever and the damper head is formed of powder-containing synthetic resin.

In accordance with another aspect of the present invention, there is provided a keyboard musical instrument comprising at least one key rotated with respect to a stationary member when a force is exerted thereon, an action mechanism actuated by the at least one key when the force is exerted on the at least one key, a hammer linked with the action mechanism and driven for free rotation after the force is exerted on the at least one key, a string struck with the hammer at the end of the free rotation and a damper including a damper lever actuated by the at least one key, a damper head, a vibration absorbing member attached to the damper head and changed between a rest position where the vibration absorbing member is held in contact with the string and a tone generating position where the vibration absorbing member is spaced from the string, wherein at least one of the damper lever and the damper head is formed of powder-containing synthetic resin.

BRIEF DESCRIPTION OF THE DRAWINGS

The features and advantages of the damper and the keyboard musical instrument will be more clearly understood from the following description taken in conjunction with the accompanying drawings in which.

DESCRIPTION OF THE PREFERRED EMBODIMENT

Figure 1:
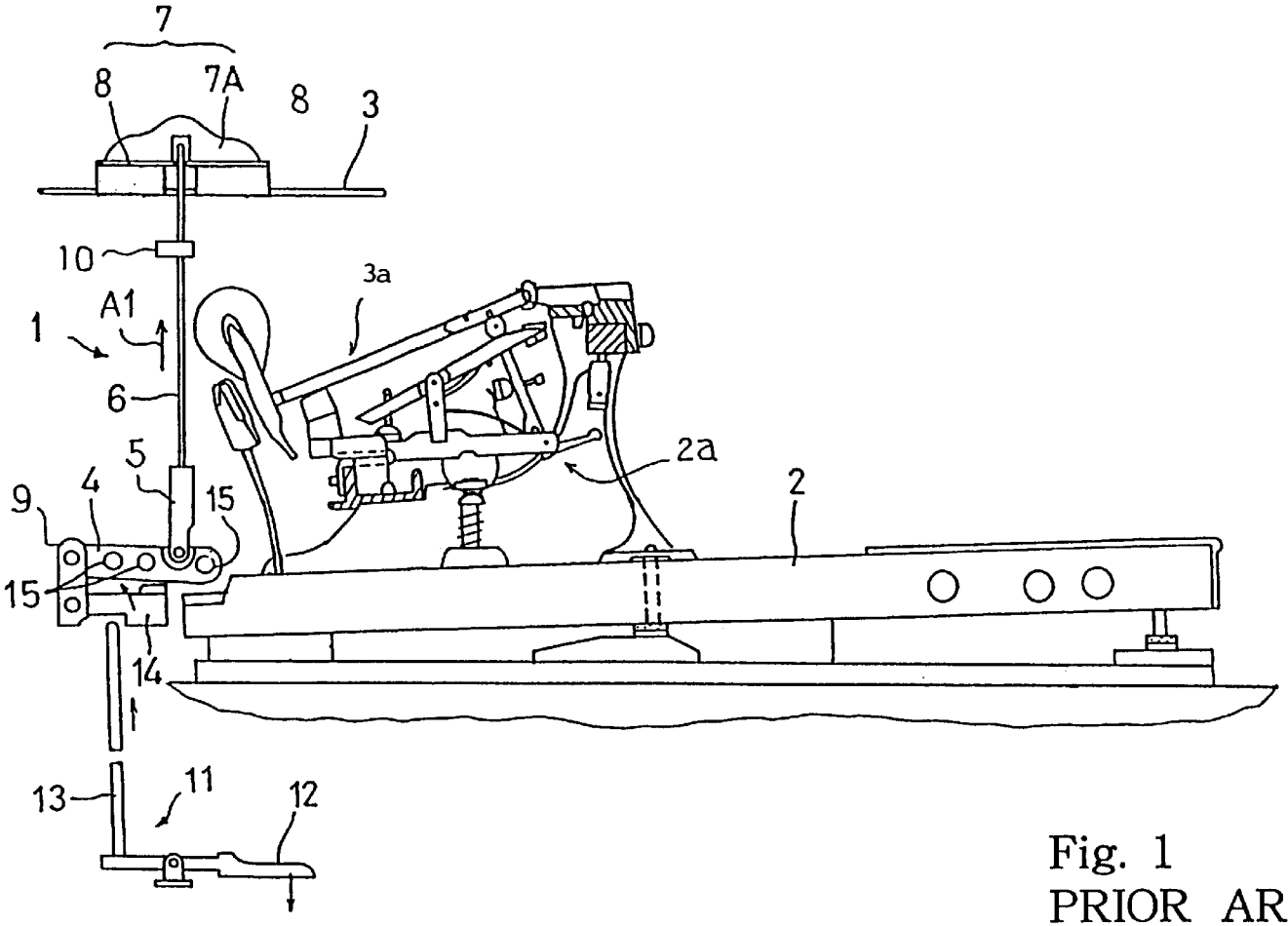
Fig. 1 PRIOR ART
FIG. 1 is a schematic side view showing the structure of the prior art damper incorporated in the grand piano.
Figure 2:
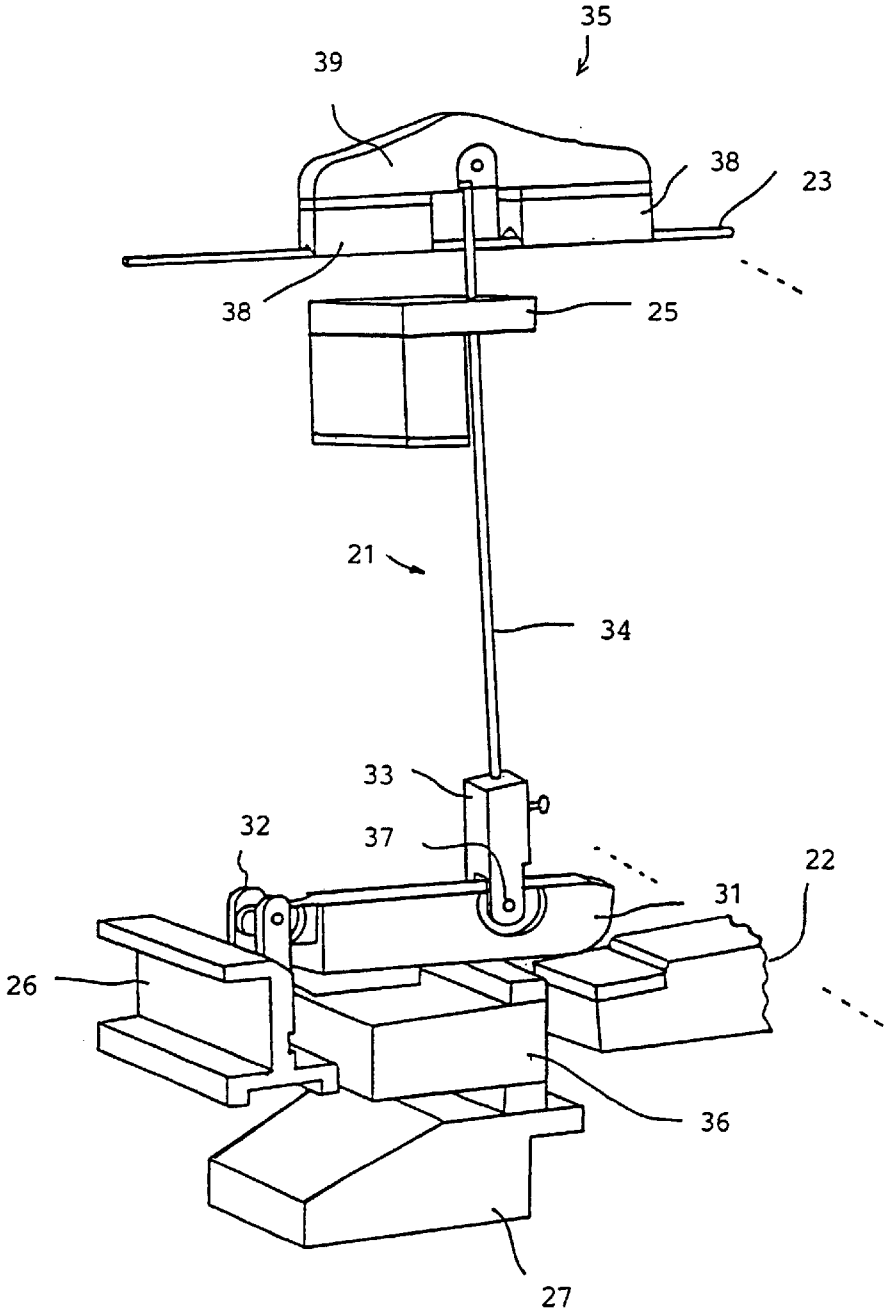
FIG. 2 is a perspective view showing the structure of a damper incorporated in a keyboard musical instrument according to the present invention.

Referring to FIG. 2 of the drawings, a damper 21 is incorporated in an acoustic grand piano embodying the present invention. The damper 21 is associated with a key 22 and a set of strings 23. A note of the scale is assigned to the key 22, and the set of strings 23 is designed to generate a piano tone at the note. Although plural keys 22 are incorporated in the acoustic grand piano together with the associated dampers 20 and the associated sets of strings 23, only one set of key, damper and strings 22/21/23 is shown in FIG. 2. The other keys, dampers and strings are represented by dot lines obliquely drawn. Eighty-eight keys 22 form in combination a keyboard, and a pianist selectively depresses and releases the keys 22. The fingering on the keyboard gives rise to rotation of the keys 22. Thus, the keys 22 are angularly movable with respect to a key bend (not shown). The action mechanisms 2*a* and the hammer assemblies 3*a* are further incorporated in the acoustic grand piano according to the present invention. However, they are omitted from FIG. 1 for the sake of simplicity. When the action mechanism and the hammer assembly are referred to in the following description, they are labeled with the references "2*a*" and "3*a*". The action mechanisms 2*a* are actuated by the depressed keys 22, and the jacks of the action mechanisms 2*a* escape from the associated hammer assemblies 3*a*. The escape gives rise to free rotation of the hammer assemblies 3*a,* and the sets of strings are struck with the hammer assemblies 3*a* at the end of the free rotation.

A lifting rail 24, a guide rail 25, a damper lever rail 26 and a dag 27 are provided inside a piano case (not shown), and relate to the damper 21. The lifting rail 24, the guide rail 25, the damper lever rail 26 and the dag 27 are fixed to or form parts of the piano case (not shown), and are stationary with respect the key bed.

The damper 21 comprises a damper lever 31, a damper lever flange 32, a damper block 33, a damper wire 34 and a damper head assembly 34. The damper lever flange 32 is upright on the damper lever rail 26, and is fixed thereto. The damper lever 31 is swingably supported by the damper lever flange 32, and forwardly projects therefrom over a lifting rail 36. The lifting rail 35 forms a part of a damper pedal mechanism. The damper pedal mechanism is similar to that incorporated in the standard grand piano, and no further description is incorporated hereinbelow for the sake of simplicity.

Figure 3:
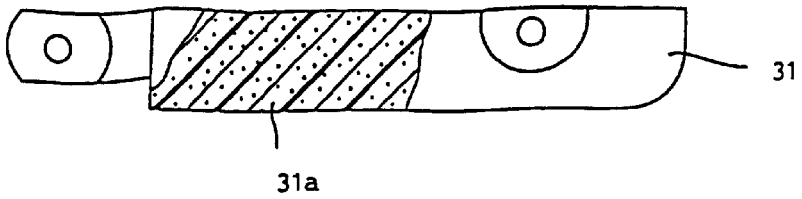
FIG. 3 is a partially cut-away side view showing a damper lever incorporated in the damper.

Although the damper lever 31 is similar in shape and dimensions to the damper lever 4, the damper lever 31 is formed of powder-containing synthetic resin as shown in FIG. 3. The powder is designated by reference numeral 31*a*. Any metal piece is not embedded in the damper lever 31, and, accordingly, the damper lever 4 is durable. The damper lever 4 will be hereinlater described in detail.

The leading end of the damper lever 31 reaches the space over the rear portion of the associated key 22. The damper block 33 is connected to the damper lever 31 by means of a pin 37, and upwardly projects therefrom. The damper block 33 is rotatable around the pin 37. The damper wire 34 is fixed to the damper block 33, and upwardly projects therefrom. A hole is formed in the guide rail 25, and the damper wire 6 passes through the hole. The hole is wide enough to permit the damper wire 34 smoothly to move therethrough. The damper head assembly 35 is fixed to the upper end of the damper wire 34. The damper lever flange 32, the damper block 33 and the damper wire 34 are similar to those of the standard grand piano. The damper lever flange 32 and the damper block 33 may be formed of wood.

Figure 4:
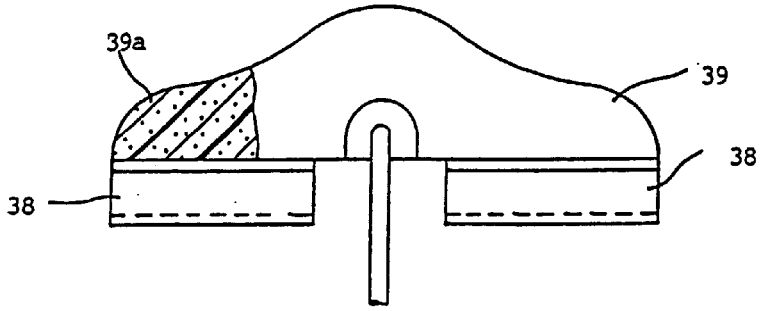
FIG. 4 is a partially cut-away side view showing a damper head incorporated in the damper.

A pair of damper felts 38 and a damper head 39 form in combination the damper head assembly 35. Although the damper head 39 is similar in shape and dimensions to the prior art damper head 7A, the damper head 39 is formed of powder-containing synthetic resin as shown in FIG. 4. The powder is designated by reference numeral 39*a*. The damper head 39 will be hereinlater described in detail together with the damper lever 31.

While the key 22 is resting, the rear portion of the key 22 is spaced from the damper lever 31, and the damper head assembly 35 urges the damper wire 34 downwardly due to the self-weight. The damper wire 34 in turn urges the damper lever 31 in the clockwise direction around the damper lever flange 32. However, the pair of damper felts 38 is held in contact with the set of strings 23, and keeps the damper lever 31 spaced from the rear portion of the key 22.

When the pianist depresses the front portion of the key 22, the front portion of the key 22 sinks toward the front rail (not shown), and, accordingly, the rear portion of the key 22 is lifted upwardly. The rear portion of the key 22 is brought into contact with the lower surface of the damper lever 31, and gives rise to rotation of the damper lever 31 around the damper flange 32 in the counter clockwise direction. Although the damper block 33 and the damper wire 34 are rotated around the damper flange 32 together with the damper lever 31, the guide rail 25 does not allow the damper wire 34 and, accordingly, the damper block 33 to be rotated around the damper flange 32. The guide rail 10 and the pin 37 convert the rotation of the damper wire 34 and the damper block 33 to straight motion. As a result, the damper block 33 and, accordingly, the damper wire 34 are moved upwardly. The damper wire 34 pushes up the damper head assembly 34, and, accordingly, the pair of damper felts 38 is spaced from the set of strings 23. Thus, the damper 21 enters the tone generating position, and allows the set of strings 23 to vibrate for generating the piano tone. The depressed key 22 further actuates the action mechanism 2*a,* and causes the jack to escape from the hammer assembly 3*a*. The escape gives rise to the free rotation of the hammer assembly 3*a,* and the set of strings 23 is struck by the hammer assembly 3*a*. Thus, the damper 21 at the tone generating position permits the set of strings 23 to vibrate for generating the piano tone.

The damper lever 31 and the damper head 39 are hereinbelow described in detail. As described hereinbefore, the damper lever 31 and the damper head 39 are formed of the powder-containing synthetic resin. It is preferable for the synthetic resin to have a relatively large specific weight. From this aspect, the damper lever 4 may be formed of synthetic resin in nylon system. It is also preferable for the powder to have a large specific weight. Any kind of powder is available for the damper lever 31 and the damper head 39 in so far as the powder has the specific weight larger than that of the wood. Iron powder, tungsten powder and copper powder are example of the powder large in specific weight. The powder is expected not to pollute the environment. The powder exposed to the surface of the damper lever/damper head 31/39 is a little, and is seldom diffused into the environment. The mixing ratio of the powder to the synthetic resin is varied depending upon the vibration absorbing capability of the damper 21. The sort of powder and/or the sort of synthetic resin may be changed for regulating the weight of the damper 21. Metal grains may be dispersed in the synthetic resin in so far as the local unbalance does not have any influence on the function of the damper lever/damper head 31/39. For this reason, word "powder" contains both of the powder and the grains in this specification.

In order to regulate the total weight of dampers 21 appropriately, the damper levers 31 and/or the damper heads 39 are varied in weight depending upon the associated set of strings 23. The dampers 31 may be varied depending upon the pitched part, i.e., the lower pitched part, the middle pitched part and the higher pitched part, or the octave to which the note of the strings belongs. Otherwise, the total weight of dampers is successively decreased from the lowest pitched tone toward the highest pitched pone so as to give the most appropriate vibration absorbing capability to each of the dampers 21. The total weight is regulable by changing the size and/or the specific weight. Although plural molding dies are required for the damper levers/damper heads 31/39 different in size, only one molding die is used for the damper levers/damper heads 31/39 in so far as the damper levers/damper heads 31/39 are formed of the power-containing synthetic resin different in specific weight.

Description is hereinbelow made on a process for producing the damper head assemblies 39. The damper head assemblies 39 are respectively incorporated in the dampers 21, which are to be actuated by the keys 21 forming in combination the keyboard. For this reason, the damper head assemblies 39 are expected to absorb the vibrations of the associated sets of strings 23. In order to make the vibration absorbing capability constant among the dampers 21, the dampers 21 are successively decreased in weight from the lowest pitched tone toward the highest pitched tone, and the damper heads 39 are varied in weight. The damper head assemblies 39 are formed of the powder-containing synthetic resin, and, accordingly, equal in specific weight. However, the damper heads 39 are different in size or dimensions.

The process starts with preparation of a molding die (not shown), metallic powder and tablets of synthetic resin. The molding die has a recess corresponding to an array of eighty-eight damper heads 39. The recess has a cross section gradually enlarged. The cross section is similar in contour to the side surface of the hammer heads 39. The recess is not shorter than the array of damper heads 39. The molding die is attached to an injection machine (not shown).

The metallic powder and the tablets of synthetic resin are regulated to a predetermined ratio. The tablets of synthetic resin are melted in the injection machine, and the metallic powder is well mixed with the melted synthetic resin. Thus, the powder-containing synthetic resin is prepared for the molding.

Figure 5:
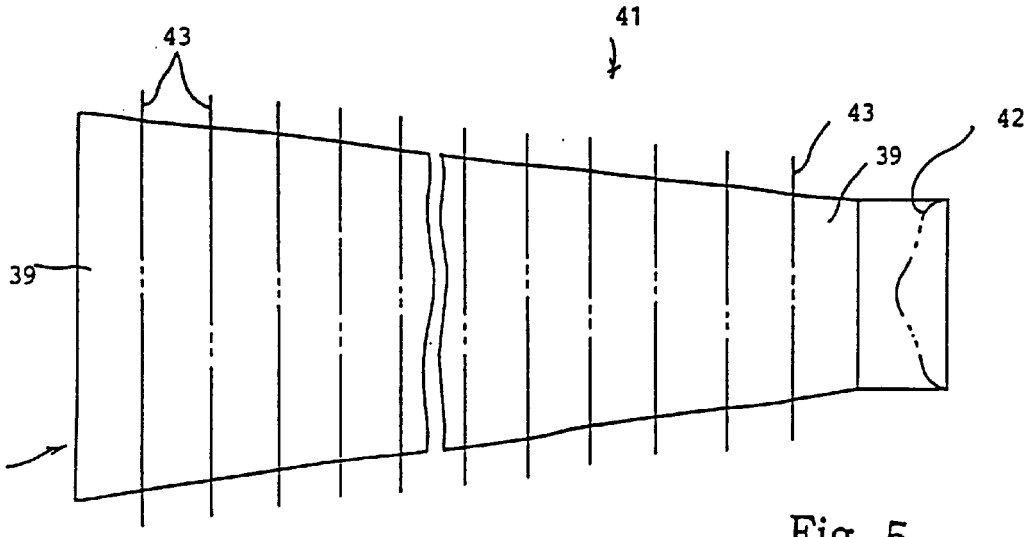
FIG. 5 is a plane view showing a block of powder-containing synthetic resin for the damper heads different in size.

The powder-containing synthetic resin is injected into the molding die, and is solidified in the molding die. The solid body 41 of powder-containing synthetic resin is taken out from the molding die. The solid body 41 of powder-containing synthetic resin has the cross section similar in contour to the side surfaces of the damper heads 39 as indicated by dots-and-dash line 42 in FIG. 5, and the cross section becomes wider from the right side toward the left side.

Subsequently, the solid body of powder-containing synthetic resin is cut along dots-and-dash lines 43, and, accordingly, separated into eighty-eight damper heads 39. The largest damper head 39 is used in the damper 21 for the string 23 assigned the lowest pitched tone, and the smallest damper head 39 is used in the damper 21 for the set of strings 23 assigned the highest pitched tone.

The pairs of damper felts 38 are fixed to the lower surfaces of the damper heads 39, respectively, and the damper head assemblies 35, the damper lever flanges 32, the damper levers 31, the damper blocks 33 and the damper wires 34 are assembled into the dampers 21 in the acoustic piano.

In case where the damper heads 39 are different in size depending upon the pitched part to which the note assigned to the associated strings 23 belongs, the molding die is formed with a recess stepwise narrowed. Namely, the recess has a zone assigned to the damper heads 39 for the lower pitched part, another zone assigned to the damper heads 39 for the middle pitched part and yet another zone assigned to the damper heads 39 for the higher pitched part, and the recess is stepwise narrowed at the boundaries between the adjacent zones. If the damper heads 39 are different in size depending upon the octave to which the note assigned to the associated strings 23 belongs, the recess is divided into plural zones assigned to the octaves, and the recess is stepwise narrowed at the boundaries between the zones.

The damper levers 31 are concurrently shaped by using a molding technique as similar to the damper heads 39.

As will be appreciated from the foregoing description, the dampers 21 according to the present invention include the damper heads/damper levers 39/31 formed of the powder-containing synthetic resin. The powder and the synthetic resin are constant in specific weight, and are stably obtainable in the market at low price. For this reason, the manufacturer can easily regulate the dampers 21 to target values of the weight, and reduces the production cost.

Moreover, the damper lever 31 has a monolithic body. Plural parts are never assembled into the damper lever 31. This means that the damper lever 31 is hardly broken down into pieces. For this reason, the damper lever 31 is durable. The dampers 21 do not contain any piece of lead, and the powder is dispersed in the synthetic resin. The powder does not pollute the environment.

In the above-described embodiment, the pair of damper felts 38 serves as a vibration absorbing member. The damper block 33, the pin 3 and the damper wire 34 as a whole constitute a link mechanism.

Although the particular embodiment of the present invention has been shown and described, it will be apparent to those skilled in the art that various changes and modifications may be made without departing from the spirit and scope of the present invention.

In the above-described embodiment, both of the damper lever 31 and the damper head 39 are varied in size. One of the damper lever 31 and the damper head 39 may be varied in size in another embodiment.

The damper levers 31 and the damper heads 39 may form parts of dampers incorporated in an acoustic upright piano.

The present invention is applicable to other kinds of keyboard musical instrument in so far as dampers form parts of the keyboard musical instruments. One of these kinds of keyboard musical instrument is an electric piano. The electric piano is fabricated on the basis of an acoustic piano, and a pickup unit such as an array of piezoelectric elements is incorporated therein. The vibrations of strings are converted to electric signals by means of the pickup unit, and electric tones are generated from the electric signals through an equalizer. The dampers according to the present invention are used for absorbing the vibrations.

Figure 6:
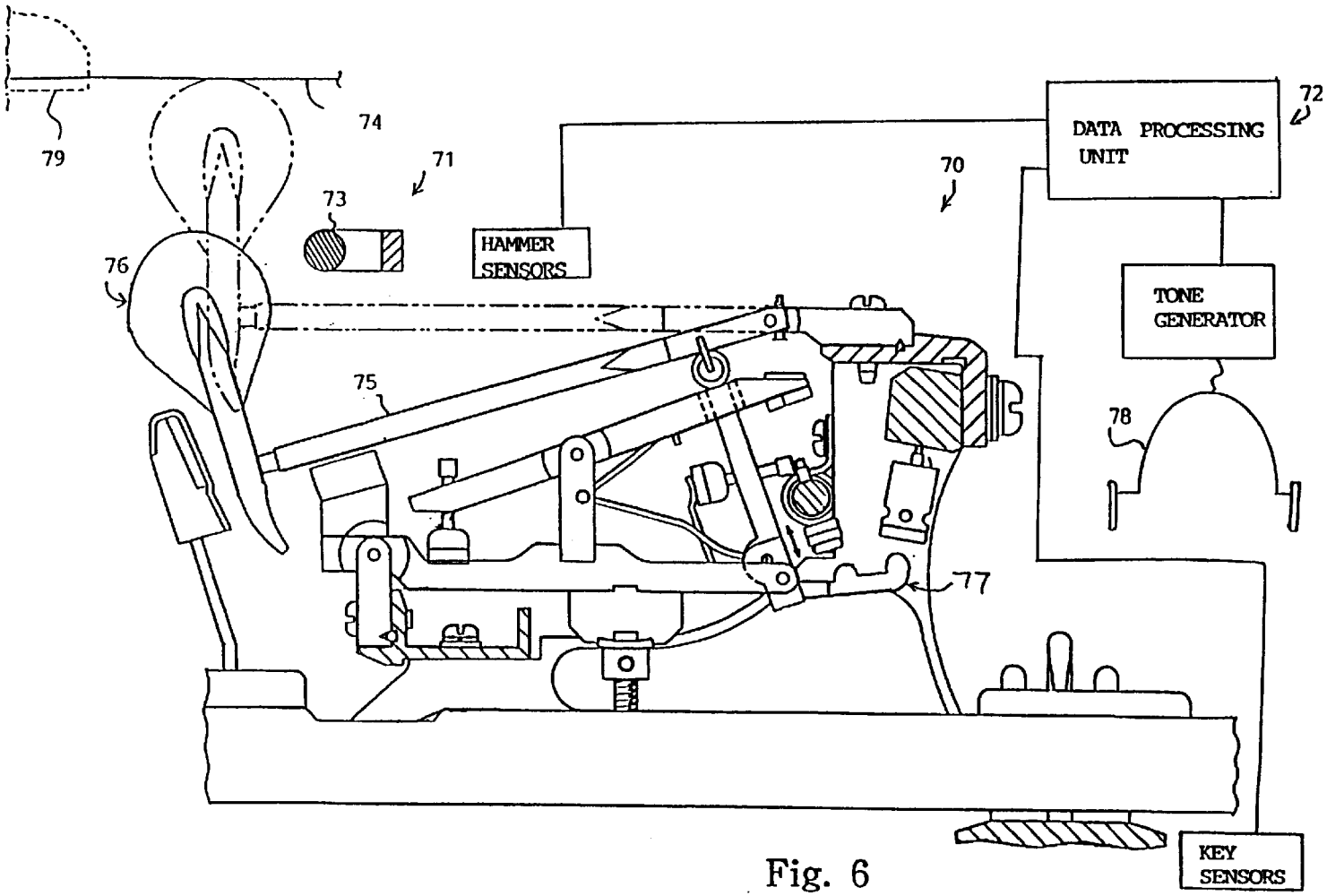
FIG. 6 is a schematic side view showing a silent piano according to the present invention.

Another kind of keyboard musical instrument to which the present invention appertains is a silent piano shown in FIG. 6. The silent piano is also fabricated on the basis of an acoustic piano 70, and a silent system 71 and an electronic sound generating system 72 are incorporated therein. The silent system 71 has a hammer stopper 73 provided between the sets of strings 74 and the hammer shanks 75, and is changed between a free position and a blocking position. When a pianist wishes to play a tune through the piano tones, the hammer stopper 73 is changed to the free position. The hammer stopper at the free position is out of the trajectories of the hammer shanks 75. While the pianist is playing the tune, the hammers 76 strike the associated sets of strings 74, and rebound on the strings 74. On the other hand, when the pianist wishes to practice the fingering without any acoustic tone, the pianist changes the hammer stopper 73 to the blocking position. The hammer stopper 73 at the blocking position is on the trajectories of the hammer shanks 75. Although the action mechanisms 77 escape from the hammers 76, the hammers 76 rebound on the hammer stopper 73 before striking the sets of strings 74, and any acoustic tone is generated from the strings. However, the electronic sound generating system 72 monitors the key/hammer motions, and generates electronic tones through a headphone 78. Thus, the pianist can check the fingering without disturbance to the neighborhood. In the silent piano, the dampers 79 according to the present invention are also used for absorbing the vibrations of the strings 74.

Figure 7:
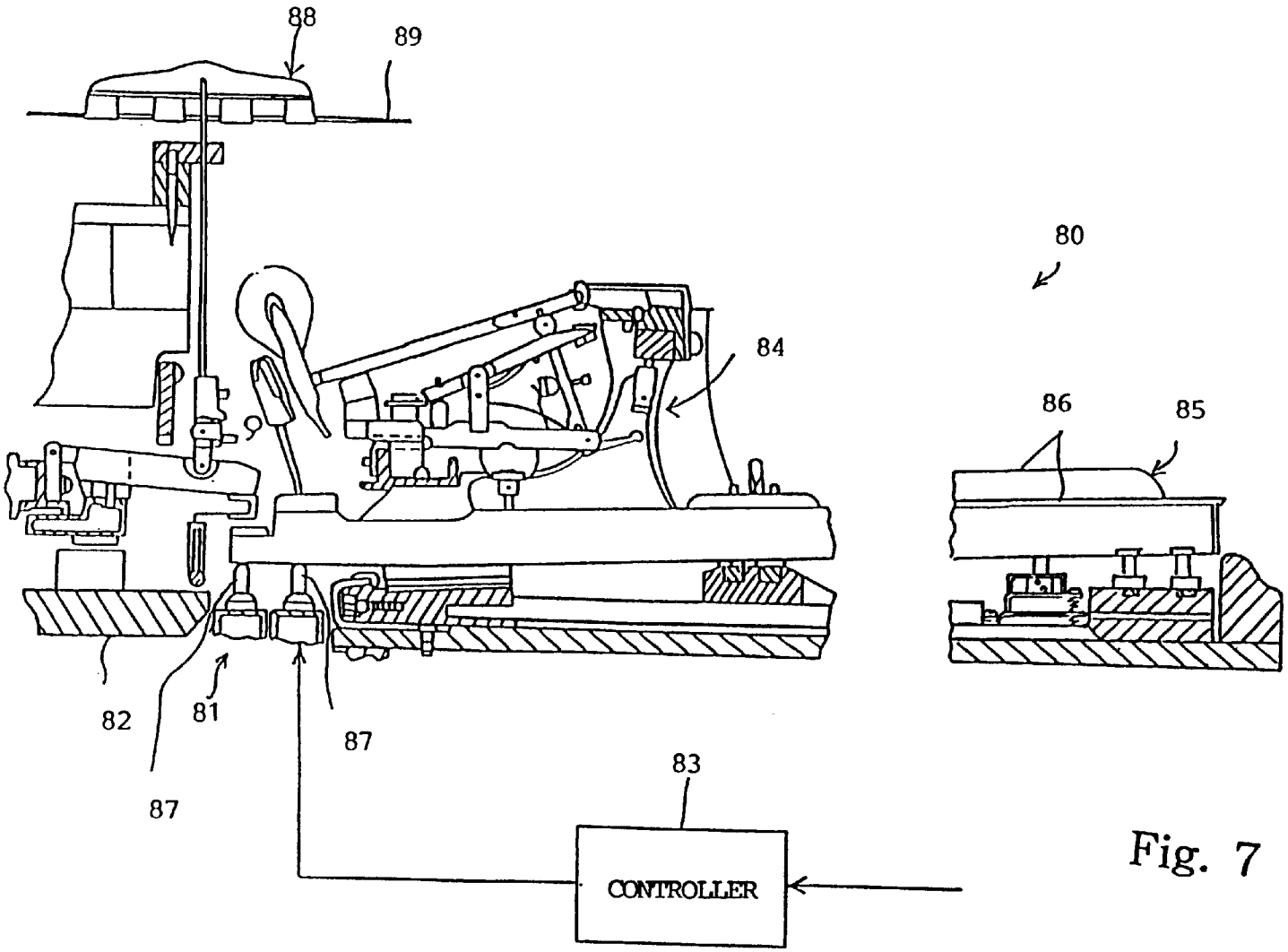
FIG. 7 is a schematic side view showing an automatic player piano according to the present invention.

Yet another kind of keyboard musical instrument is an automatic player piano shown in FIG. 7. The automatic player piano is also fabricated on an acoustic piano 80. The automatic player piano has an array of solenoid-operated key actuators 81 embedded in the key bed 82, and a controller 83 supplies driving signals to the solenoid-operated key actuators 81 for actuating the action mechanisms 84 without any fingering on the keyboard 85. A set of music data codes is loaded to the controller 83, and the controller 83 determines the black/white keys 86 to be moved, times to move the black/white keys 86 and the magnitude of the key velocity on the basis of the music data codes. The controller 83 produces the driving signals, and selectively supplies the driving signals to the solenoid-operated key actuators 81. The solenoid-operated key actuators 81 are selectively energized with the driving signals, and the plungers 87 project so as to move the associated black/white keys 86. The dampers 88 according to the present invention are provided in the automatic player piano 80, and absorb the vibrations of the strings 89. The automatic player piano may be further equipped with the silent system.

What is claimed is:

1. A damper system including a plurality of dampers for absorbing vibrations of associated strings, comprising:

a plurality of damper levers each forming a part of one of said plurality of dampers, said damper levers actuated for rotation by associated keys;

a plurality of damper assemblies each forming another part of one of said plural dampers, and having respective damper heads and respective vibration absorbing members respectively fixed to said damper heads, and independently changed between rest positions where said vibration absorbing members are held in contact with said strings and tone generating positions where said vibration absorbing members are spaced from said strings, wherein at least one of said damper levers and said damper heads being formed of powder-containing synthetic resin, different ones of the said damper levers and/or damper heads respectively being different in at least one of specific weight or size depending upon the pitch of tones to be generated by said strings; and a plurality of link mechanisms respectively connected between said damper levers and said damper heads for transmitting forces from said damper levers to said damper assemblies.

2. The damper as set forth in claim 1, in which powder in said powder-containing synthetic resin has a specific weight larger than a specific weight of wood.

3. The damper as set forth in claim 2, in which said powder is formed of metal.

4. The damper as set forth in claim 3, in which said metal is selected from the group consisting of iron, tungsten and copper.

5. The damper as set forth in claim 1, in which synthetic resin in said powder-containing synthetic resin is in a nylon system.

6. The damper as set forth in claim 1, in which said damper lever is formed of said powder-containing synthetic resin.

7. The damper as set forth in claim 1, in which said damper head is formed of said powder-containing synthetic resin.

8. The damper as set forth in claim 1, in which both of said damper lever and said damper head are formed of said powder-containing synthetic resin.

9. The damper as set forth in claim 1, in which said link mechanism includes a pin, a damper block rotatably connected to said damper lever by means of said pin and a damper wire connected between said damper head and said damper block.

10. The damper as set forth in claim 1, in which said vibration absorbing member is formed of felt.

11. A damper system including a plurality of dampers for absorbing vibrations from associated strings, comprising:

a plurality of damper flanges fixed to a stationary member;

a plurality of damper levers rotatably connected at boss ends thereof to said damper flanges, respectively, having having leasing end portions over keys, and formed of powder-containing synthetic resin;

a plurality of damper blocks rotatably connected to said damper levers by means of pins, respectively;

a plurality of damper wires having first end portions and second end portions fixed to said plurality of damper blocks;

a plurality of damper heads connected to said first end of portions of said damper wires, and formed of said powder-containing synthetic resin, at least one of said damper levers and said damper heads being different in specific weight or size depending upon the pitch of tones to be generated by said strings; and a plurality of damper felt members respectively attached to said damper heads, and changed between rest positions for absorbing said vibrations and tone generating positions for permitting said strings to vibrate.

12. A keyboard musical instrument comprising:

a plurality of keys rotated with respect to a stationary member when forces are exerted thereon respectively;

a plurality of action mechanisms actuated by said plurality of keys when said forces are exerted on said plurality of keys;

a plurality of hammers respectively linked with said action mechanisms and driven for free rotation after said forces are exerted on said plurality of keys;

a plurality of strings respectively struck with said hammers at the end of said free rotation for generating acoustic tones, respectively; and a plurality of dampers including damper levers respectively actuated by said plurality of keys, damper heads, vibration absorbing members respectively attached to said damper heads and changed between rest positions where said vibrating absorbing members are held in contact with said strings and tone generating positions where said vibration absorbing members are spaced from said plurality of strings, wherein at least one of the damper levers and the damper heads are formed of powder-containing synthetic resin, and are different in at least one of specific weight or size depending upon the pitch of tones to be generated by said strings.

13. The keyboard musical instrument as set forth in claim 12, in which at least one key forms a keyboard together with other keys, and other action mechanisms, other hammers and other dampers similar in structure to said damper are associated with said other keys so as selectively to strike other strings for generating tones different in pitch from one another.

14. The keyboard musical instrument as set forth in claim 13, in which said damper and said other dampers arc selectively adjusted to target weights for exhibiting a target vibration absorbing capability.

15. The keyboard musical instrument as set forth in claim 14, in which said damper head and damper heads of said other dampers are formed of said powder-containing synthetic resin, and are selectively adjusted to different weights.

16. The keyboard musical instrument as set forth in claim 15, in which said different weights are given to all of said damper heads, respectively.

17. The keyboard musical instrument as set forth in claim 15, in which said different weights are given to the damper heads for a lower pitched part, the damper heads for a middle pitched part and the damper heads for a higher pitched part, respectively.

18. The keyboard musical instrument as set forth in claim 15, in which said different weights are given to plural groups of said damper heads respectively associated with different octaves, respectively.

19. The keyboard musical instrument as set forth in claim 12, further comprising a silent system having a stopper changed between a free position and a blocking position, said stopper at said free position being out of a trajectory of said hammer so that said hammer strikes said string without any interference thereof, said stopper at said blocking position being on said trajectory of said hammer so that said hammer rebound on said stopper before striking said string, and an electronic sound generating system for generating an electronic tone without said acoustic tone.

20. The keyboard musical instrument as set forth in claim 12, further comprising an actuator held in contact with said at least one key and energized for moving said at least one key without any force exerted thereon by a player, and a controller connected to said actuator and responsive to pieces of music data information for selectively energizing said actuator.

21. The keyboard musical instrument as set forth in claim 20, further comprising a silent system having a stopper changed between a free position and a blocking position, said stopper at said free position being out of a trajectory of said hammer so that said hammer strikes said string without any interference thereof, said stopper at said blocking position being on said trajectory of said hammer so that said hammer rebound on said stopper before striking said string, and an electronic sound generating system for generating an electronic tone without said acoustic tone.

* * * * *